US005649345A

United States Patent [19]

Menegatto

[11] Patent Number: 5,649,345

[45] Date of Patent: Jul. 22, 1997

[54] TEXTURING MACHINE WITH HEAT EXCHANGER FOR FORCED YARN COOLING

[75] Inventor: Carlo Menegatto, Monza, Italy

[73] Assignee: Menegatto S.R.L., Milan, Italy

[21] Appl. No.: 598,217

[22] Filed: Feb. 7, 1996

[30] Foreign Application Priority Data

Feb. 17, 1995 [IT] Italy ..... MI95A0294

[51] Int. Cl.[6] ..... D02G 1/02; D02J 13/00

[52] U.S. Cl. ..... 28/249; 28/217; 57/284; 57/308; 62/380

[58] Field of Search ..... 28/217, 249, 247; 57/290, 284, 308; 62/380, 63

[56] References Cited

U.S. PATENT DOCUMENTS

| | | | |
|---|---|---|---|
| 3,584,450 | 6/1971 | Crouzet | 28/247 |
| 3,999,360 | 12/1976 | Forin et al. | 57/280 |
| 4,027,466 | 6/1977 | Brehm | 57/290 |
| 4,035,879 | 7/1977 | Schippers | 28/246 |
| 4,331,000 | 5/1982 | Luthi | 57/284 |

FOREIGN PATENT DOCUMENTS

| | | | |
|---|---|---|---|
| 0 403 098 | 12/1990 | European Pat. Off. . | |
| 0 659 913 | 6/1995 | European Pat. Off. . | |
| 2 320 999 | 3/1977 | France . | |
| 2380363 | 10/1978 | France | 57/284 |
| 405331725 | 12/1993 | Japan | 57/284 |

*Primary Examiner*—Andy Falik
*Attorney, Agent, or Firm*—Young & Thompson

[57] ABSTRACT

A texturing textile machine has at least one heating oven for the yarn (20) and downstream thereof a relevant texturing or false-twist spindle (22). There is provided between the yarn heating oven (20) and the relevant texturing spindle (22) yarn cooling elements (28,30) for the forced cooling of the yarn.

21 Claims, 5 Drawing Sheets

TEXTURING MACHINE WITH HEAT EXCHANGER FOR FORCED YARN COOLING

FIELD OF THE INVENTION

The present invention relates to the sector of texturing machines, that is to say those machines intended to provide a permanent plastic deformation, otherwise known as false twist, for a synthetic yarn in order to increase its apparent volume and stretchability.

More particularly it relates to a device for cooling yarn leaving the heating oven and moving towards the texturing or false-twist spindle, suitable for providing the aforementioned permanent plastic deformation in the yarn.

BACKGROUND OF THE INVENTION

It is in fact known that, in order to perform texturing of yarn, the latter must be heated up to a predetermined temperature, which varies according to the type of yarn subjected to texturing, in such a way that by changing its structure it is possible to provide it with permanent plastic deformation. To prevent the yarn from entering the twisting spindle when it is still too hot, i.e. when it is excessively softened, which would make proper performance of the false twist deformation problematical, the heating phase has to be followed by a phase of cooling which allows the yarn to be brought into a more suitable state for undergoing the deformation of false twisting.

In texturing machines known hitherto, the yarn either runs freely between the oven and false-twist spindle in direct contact with the air of the working environment of the machine, or runs in contact with a suspended metal cooling channel having a temperature equal to the temperature of the working environment of the machine. Thanks to the high thermal conductivity of the metal. The channel allows faster lowering of the temperature of the yarn and hence a slightly shorter route for the yarn between the heating oven and the twist spindle compared to the first case wherein the yarn runs freely in direct contact with the working air.

In practice, according to the traditional method, cooling of the yarn only took place thanks to the exchange of heat of the same with the air of the working environment of the machine surrounding the yarn cooling zone or by the exchange of heat with the latter and the cooling channel, the latter having the same temperature as the air of the working environment surrounding it.

The air at ambient temperature near the cooling channel and/or the hot yarn which has left the oven, takes from the latter a certain quantity of heat, heats up and is renewed around the yarn thanks only to the slow convective movements generated by the natural displacement of the masses of air having a different temperature. The cooling efficiency obtained by exploiting such a traditional method is definitely low. As a result the cooling route must nevertheless, in both the cases referred above, be of considerable length.

An excessively long route of the yarn between the oven and false-twist spindle forces bulky machines to be built which occupy an excessive space inside the working environments.

In traditional machines, in the case wherein yarns with different features have to be treated, more particularly those which require cooling to a greater or lesser degree accordingly, the machine has to be modified structurally in order to increase or decrease the path between the heating oven and the false-twist spindle. This entails additional costs for the labour employed in these operations and losses of production due to machine down times.

With traditional texturing machines, it is not possible moreover to regulate the quantity of thermal energy removed by the yarn, with the result that yarns of different thickness, as also those fed at speeds other than those for which the machine has been built, may not be textured in an optimum manner and therefore have texturing defects which cause their depreciation on the market with serious economic damage for the manufacturers.

The object of the present invention is that of providing a machine for texturing yarn which avoids the aforementioned disadvantages of traditional machines and, in particular, in which the yarn follows a path between the heating oven and the false-twist spindle which is extremely short and wherein it is also possible to achieve controlled lowering of the temperature of the yarn in such a way that a same texturing machine is suitable, without undergoing any structural modification, for texturing yarns of different types and sizes, without thereby undergoing any decrease in production yield.

SUMMARY OF THE INVENTION

The previous objects are achieved by providing a texturing textile machine of the type comprising at least one yarn heating oven and downstream of the latter a relevant texturing or false-twist spindle which is characterized in that it comprises means for the forced cooling of the yarn between the heating oven for the yarn and the relevant texturing spindle.

"Forced" cooling of the yarn here refers to the fact of acting on the yarn, unlike what has been implemented hitherto, or simply with the use, as a cold temperature source, of the air in a virtually static condition situated around the yarn, in such a way as to achieve coercive cooling therein, for example by force-blowing air against the "hot" yarn, or by placing the latter in contact with a cold temperature source having a temperature lower than that of the air of the working environment of the texturing machine.

In this way greater cooling efficiency is achieved for the yarn leaving the heating oven and a shorter path for the yarn between the oven and the false-twist spindle compared to what was achieved with traditional texturing equipment.

According to the invention, a particularly advantageous solution provides between the heating oven and the texturing spindle a contact and cooling surface whereon the "hot" yarn leaving the oven runs, and is characterized in that the means for forced cooling comprise at least one heat exchanger element, touching the contact and cooling surface, for the exchange of heat between a cooling fluid, which circulates therein, and the channel whereon the yarn runs, and means of cooling and circulation inside of the heat exchanger element for the cooling fluid.

In this way it is possible, by varying the temperature of the cooling fluid, to achieve the necessary cooling for the particular type of yarn being processed.

Thus, in addition to considerable cooling efficiency, the possibility is obtained of implementing a system, possibly automated, for controlling cooling of the yarn between the oven and false-twist spindle, in order to achieve optimum texturing of the yarn and complete automation of the texturing process.

A particularly advantageous solution provides for the use, as cooling means, of a refrigerator in order to achieve particularly low temperatures of the cooling fluid and hence obtain a path between the oven and false-twist spindle which is particularly short.

BRIEF DESCRIPTION OF DRAWINGS

The present invention will in any case be made clearer on reading the following description, relating to preferred embodiments of the present invention, said description having to be read with reference to the accompanying drawings, in which.

DESCRIPTION OF PREFERRED EMBODIMENTS

Figure 1:
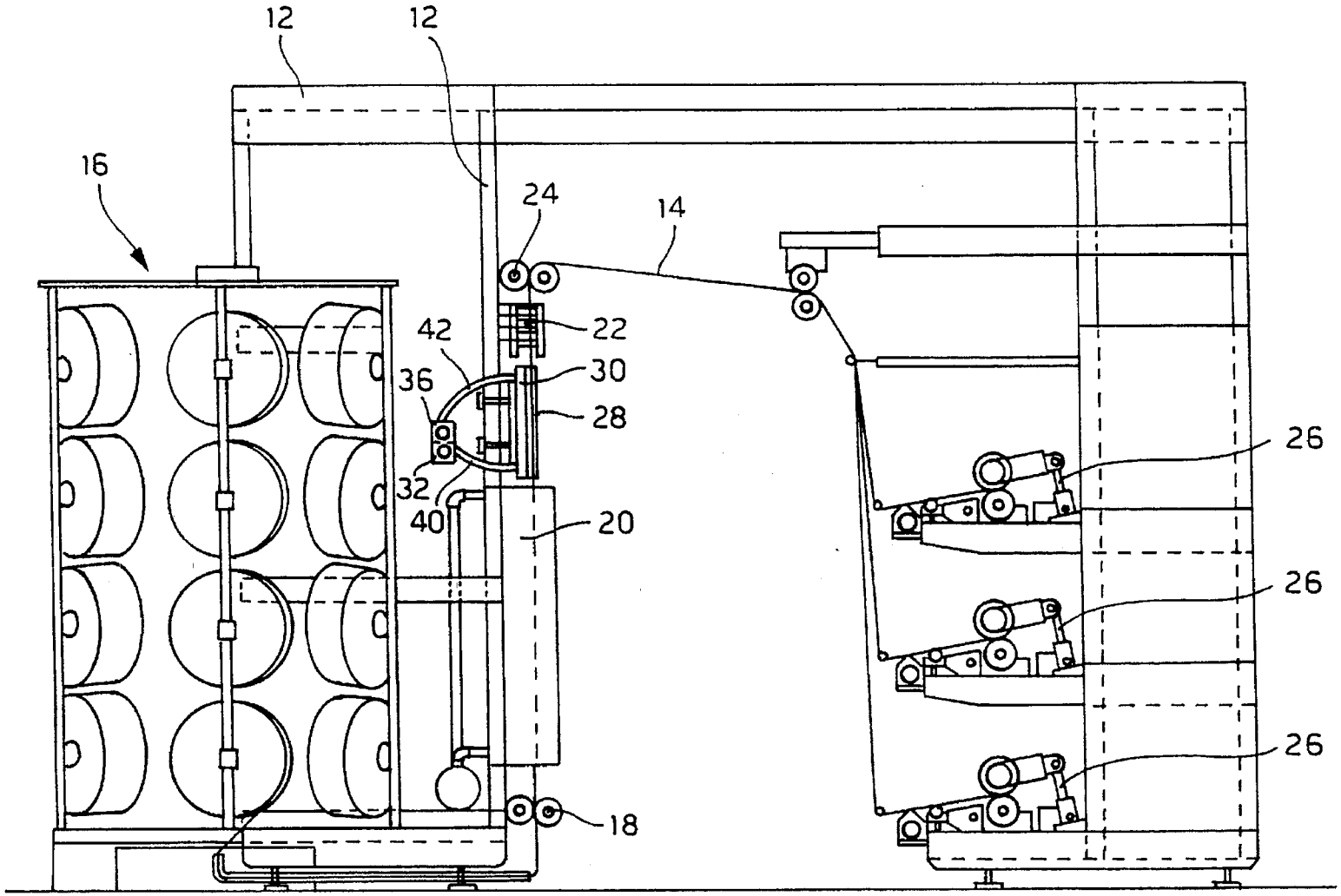
FIG. 1 is a sectioned view of a texturing machine according to the present invention.
Figure 2:
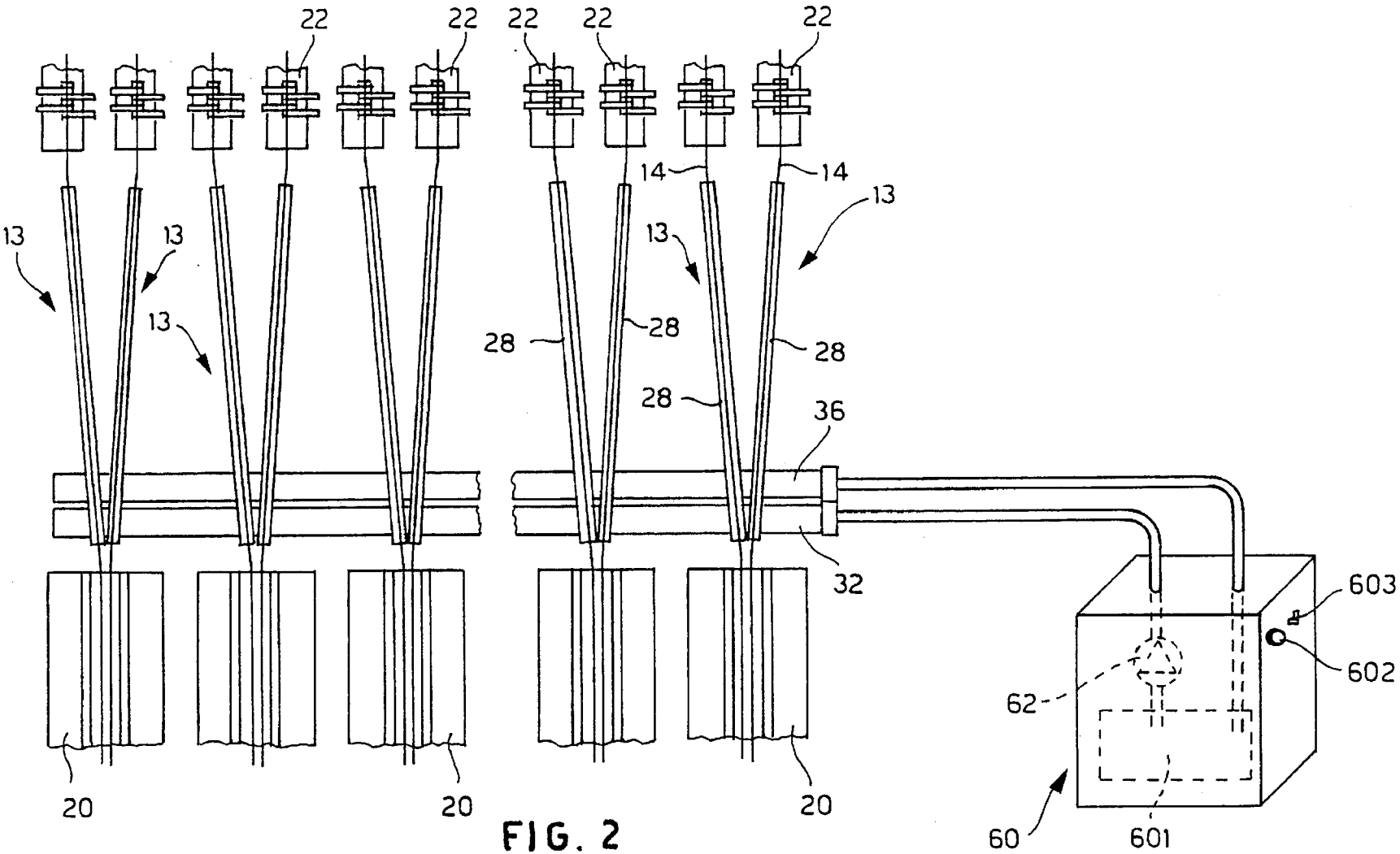
FIG. 2 is a front view of a portion of the texturing machine showing the cooling system of the present invention.

FIG. 1 shows a sectioned view of a texturing machine according to the present invention, which comprises a framework 12 for the support, as can be seen better in FIG. 2, of a plurality of sections 13 for texturing the yarns 14, stored on the reels of a creel 16, from which they are fed, by means of drive members 18, towards heating ovens 20 and downstream of the latter towards relevant texturing or false-twist spindles 22. As shown in this FIG. 1, the textured yarns 14 leaving the respective false-twist spindle 22 are then sent, thanks to the drive members 24, to the assemblies 26 for collecting the yarn on cops.

According to the invention, unlike what has been performed to date, provision is made to carry out forced cooling of the yarn after it leaves the oven 20. Forced cooling, as already mentioned, refers here to the fact that the yarn is no longer cooled by the simple contact of the air or of materials at ambient temperature, but that it is deliberately subjected to the action of suitable means designed to induce greater cooling than that which can be recorded using as a source of lower temperature the environment in which the texturing machine operates.

The present embodiment of a texturing machine comprises in a traditional manner, between each heating oven 20 and the respective texturing spindles 22, a channel 28 whereon the "hot" yarn 14 runs, having left the oven 20.

Figure 3:
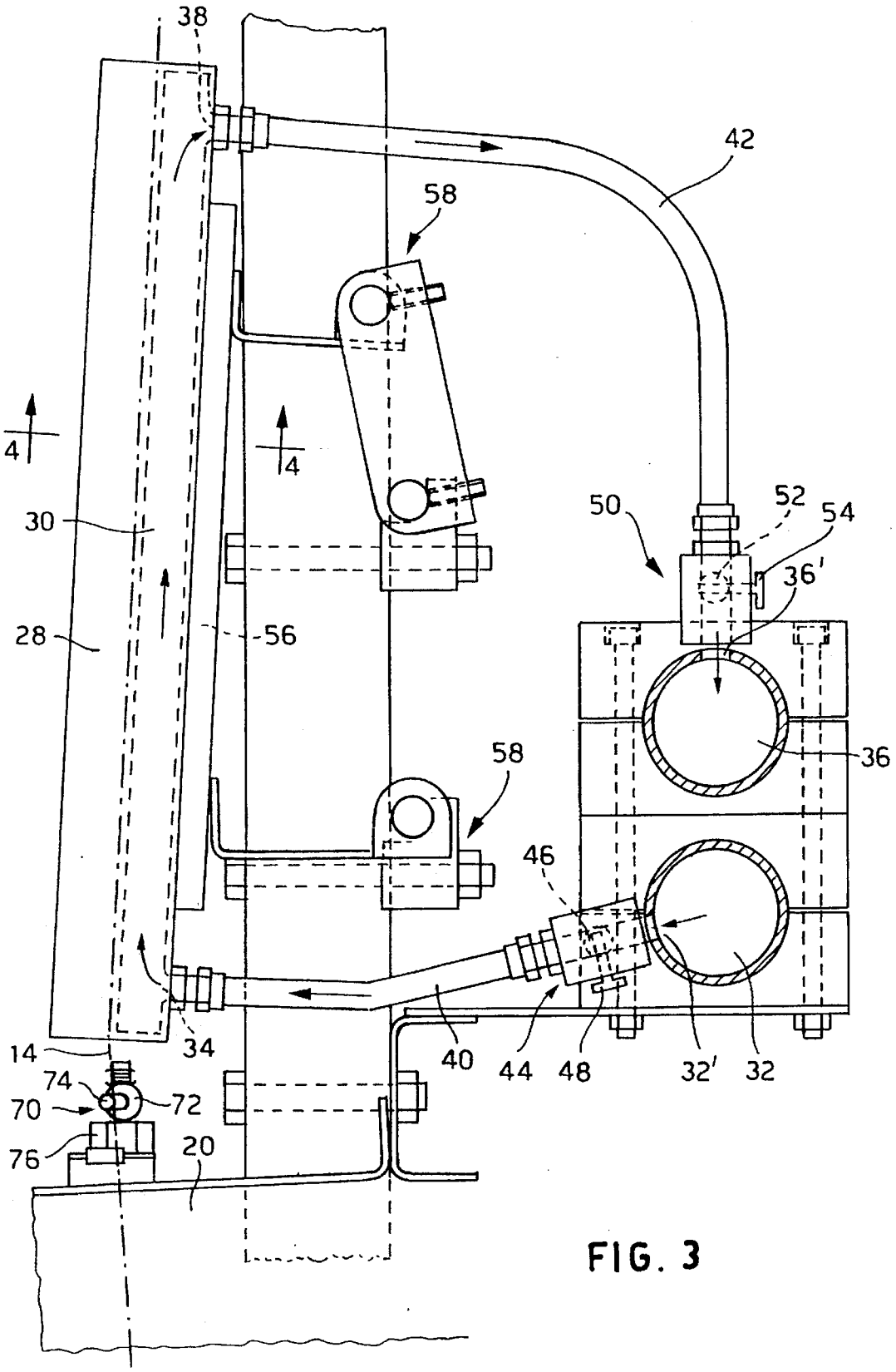
FIG. 3 is a sectioned view showing solely the cooling system of the present invention.
Figure 4:
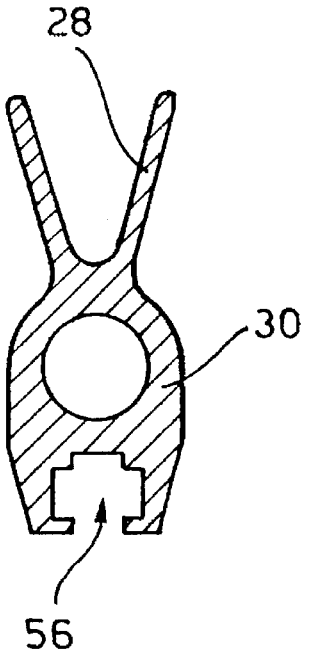
FIG. 4 is a sectioned view taken along line 4—4 of FIG. 3, showing the heat exchanger body according to the preferred embodiment of the present invention.

With reference also to FIGS. 3 and 4, it can be seen how, according to the invention, the forced cooling of the yarn is performed by providing in each texturing section a heat exchanger element 30 placed in contact with the contact and cooling channel 28 so as to generate an exchange of thermal energy between a cooling fluid which circulates therein and the channel 28 whereon the yarn 14 runs. In this way the contact and cooling channel 28 always remains at a constant temperature and does not overheat due to the constant contact of the hot yarn, as however was the case previously in traditional texturing machines.

More particularly, it can be seen from the figures that the heat exchanger element 30 is preferably composed of a single tubular flow element for the cooling fluid with a substantially rectilinear configuration.

The flow pipe 30 for the cooling fluid and the contact and cooling channel 28 for the yarn 14, in order to encourage the exchange of heat energy to a maximum, are made in the form of a single unitary and integrated body.

It is also preferred to make the body defining the channel 28 and the cooling pipe 30 in a metal material which, given the high conductivity, allows an efficient exchange of heat. More particularly, the body is made of aluminium which does not undergo the damaging effects of oxidation which would be encouraged should water be used as a cooling fluid. The alumnium body is subjected to an anodizing treatment which makes it resistant to the cuts caused by constant rubbing of the yarn.

The cooling fluid is fed into the exchanger 30 by means of a first delivery conduit 32 connected to a feed hole 34 of the tubular element 30 positioned at one end of the pipe 30, while it is removed from the pipe 30 by means of a second return conduit 36, connected to an exhaust hole 38 of the tubular element 30 positioned at the opposite end of the pipe 30.

More particularly, as shown in the figures, the feed hole 34 is arranged lower than the exhaust hole 38 so as to provide a circulation of fluid inside the pipe 30 which goes from the bottom upwards and achieve initial filling of the pipe 30 with gradual expulsion of all the air contained in the pipe, in order to avoid the presence of air bubbles in the circuit of the cooling fluid and thus achieve optimum cooling yields.

As shown in this preferred embodiment, for the connection between the delivery conduit 32 and the feed hole 34 of the cooling pipe and the return conduit 36 and the exhaust hole 38 of the cooling pipe, respective connection hoses 40, 42 are provided.

Upstream of the connection hoses 40, 42 suitable parts for intercepting the cooling fluid are inserted.

More particularly, between the first delivery conduit 32 and the heat exchanger element 30 a first part 44 for intercepting the cooling fluid is inserted, having a gate valve 46 and a knob 48 for controlling the gate valve 46, so as to regulate manually or prevent circulation of the fluid inside the heat exchanger element 30. Whereas between the heat exchanger element 30 and the second return conduit 36 a second part 50 for intercepting the cooling fluid is inserted, having a gate valve 52 and a knob 54 for controlling the gate valve 52.

The interception parts 44 and 50 allow circulation of the cooling fluid to be disconnected in those working sections which are not in operation, thus achieving a saving in the quantity of cooled fluid to be used or in the running costs of the cooling system, or allowing replacement of the yarn cooling elements 28, 30.

The use of the connection hoses 40, 42 allows a cooling pipe 30 of any required length to be inserted between them.

FIG. 4 also shows how the body comprising the contact and cooling channel and the cooling pipe has, on the side opposite to that of the channel 28, a longitudinal groove 56 for insertion of the parts 58 (shown in FIG. 3) for attaching the device for cooling the yarn according to the present invention to the framework 12 of the machine.

The attachment parts 58 slide inside the groove 56 wherein they can be attached to regulate the height of the position of the cooling body. According to the invention suitable means for cooling and circulation are provided inside the heat exchanger element 30 for the cooling fluid. As shown in FIG. 2, they comprise a refrigerator 60 for the fluid, having pumping means 62 for the circulation of the fluid, connected to the heat exchanger elements 30 via the first delivery manifold conduit 32 and the second return manifold conduit 36.

The refrigerator 60 comprises, as shown, a tank 601 for refrigeration of the fluid and has knobs 602, 603 respectively for setting the temperature of the cooling fluid and for regulating the delivery speed of the fluid inside the cooling circuit or of the flow rate of the pump 62, which allows the temperature and circulation speed of the fluid to be set as required to achieve the necessary cooling.

Such a cooling circuit is a closed circuit wherein virtually always the same quantity of cooling fluid circulates, which, not coming into contact with the external environment, is not contaminated by the latter and does not in turn contaminate it.

It can obviously be foreseen for the present invention to control the refrigerator 60 and the related delivery pump 62 by suitable computerised means, in order to be then able to operate on any type of synthetic yarn in a totally automated manner.

Water is preferably used as cooling fluid, even if the use of any other suitable fluid, for example of the type used in cooling systems, can be foreseen for the present invention.

For feeding of the heat exchanger elements the first delivery conduit 32 and the return conduit 36 have a plurality of holes which are aligned and longitudinally distanced one from the other, denoted by 32' and 36' respectively in FIG. 3.

Figure 5:
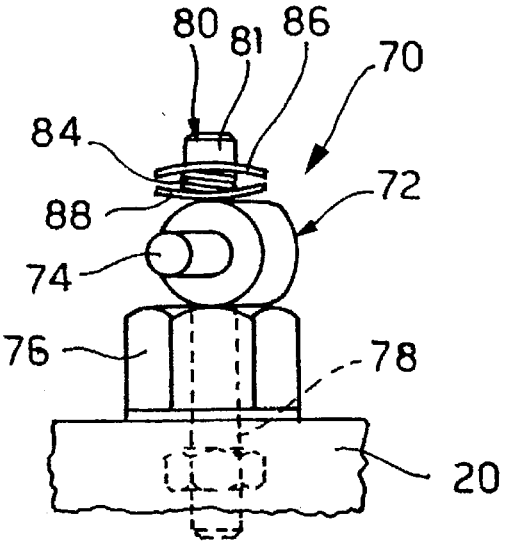
FIG. 5 is a side view of a device for pressing the yarn against said contact and cooling channel of the present invention.
Figure 6:
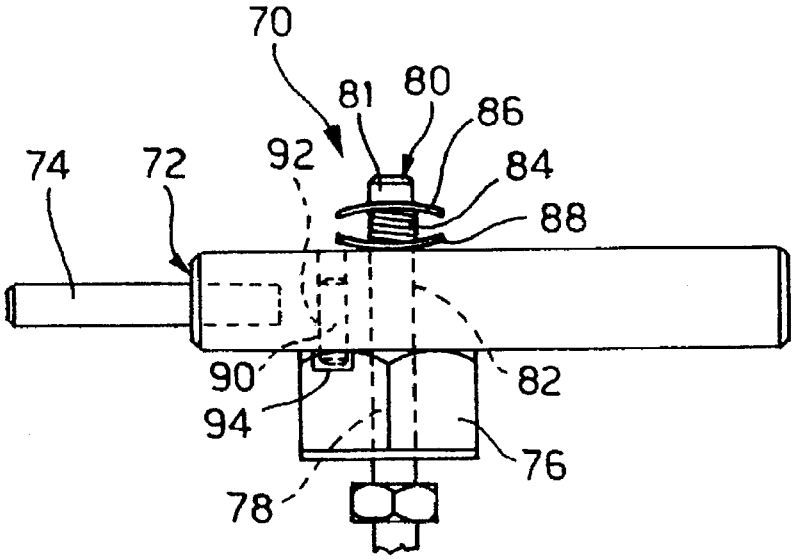
FIG. 6 is a front view of the device for pressing the yarn against said contact and cooling channel of the present invention.

As shown also in the subsequent FIGS. 5 and 6, upstream of each contact and cooling channel 28, between the latter and the heating oven 20, attached directly to the yarn heating oven 20, a part 70 is provided for pressing the yarn against the contact and cooling channel 28.

The yarn pressing means 70 comprise a tilting rod 72 having an end 74 for contact and pushing of the yarn against the channel 28 and means for locking the rod 72 in the position of contact and pressing of the yarn.

As shown, a support nut 76 attached to the upper face of the oven 20 has a hole 78 wherein a bolt 80 is inserted, crossing through a central hole 82 of the rod 72. Between the head 81 of the hinging bolt 80 and the rod 72 a thrust spring 84 is provided and restrained by two opposite plates 86, 88 respectively.

The means for holding the rod 72 in contact with the yarn, comprise a peg 90 for locking rotation of the rod 72 inserted in a hole 92 of the rod 72 and projecting downwards, suitable for being inserted in an insertion cavity 94 formed in the upper face of the nut 76. The elastic thrust means 84 act so as to push the peg 90 into the cavity 94.

In normal working conditions, the rod 72 is blocked against the yarn. If it is to be disengaged therefrom, it is sufficient to pull it upwards, resisting the spring 84, to remove the peg 90 from the cavity 94 and then rotate it so as to move it away from the yarn.

Figure 7:
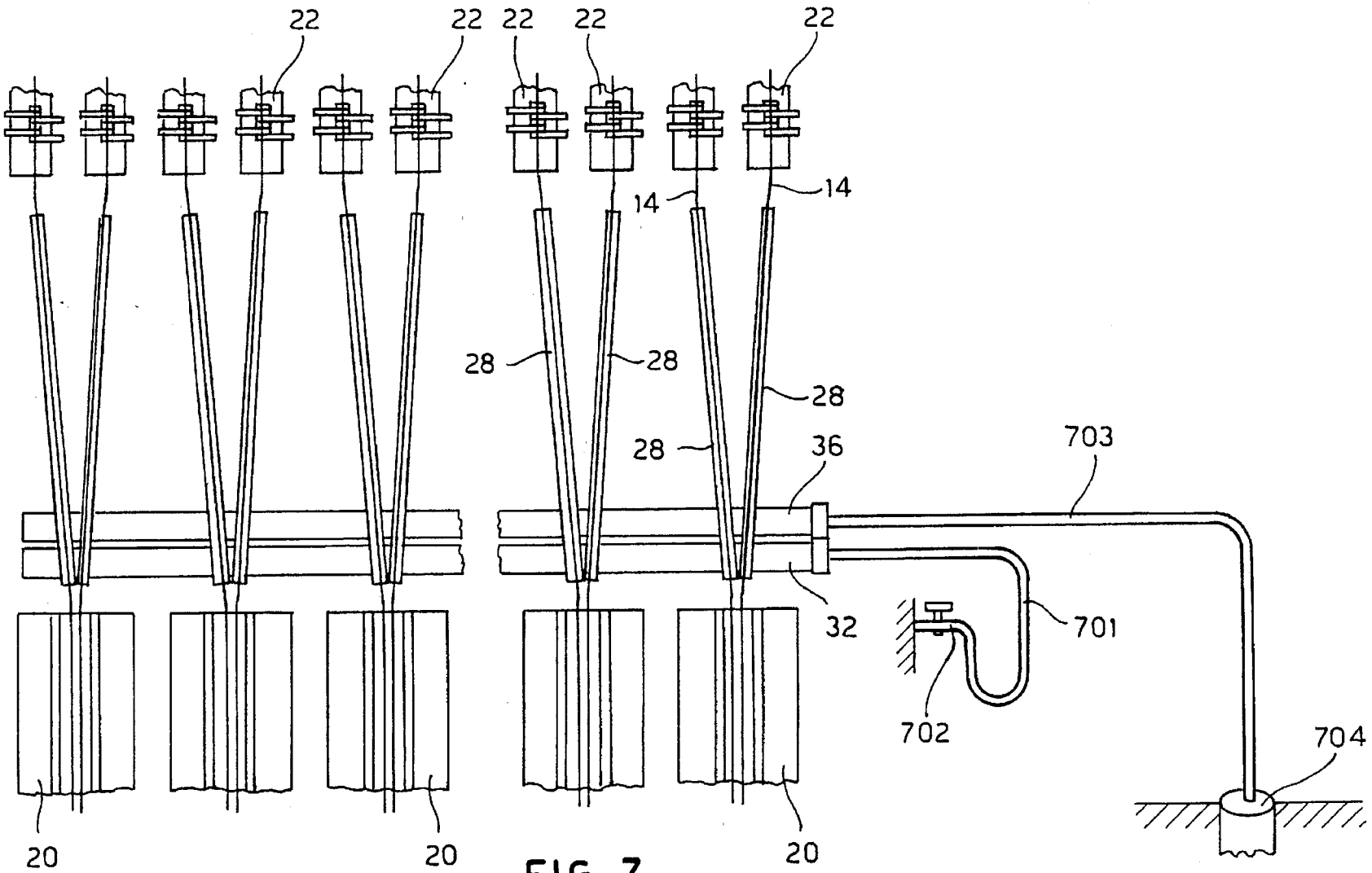
FIG. 7 is a view similar to that of FIG. 2 relating to a second preferred embodiment of the present invention.

FIG. 7 shows a second preferred embodiment of the present invention. This second solution has the advantage of being extremely simple, low in cost and easily implemented in the case of the impossibility of using the refrigerator or other means which have to be supplied electrically or by fuels.

It provides piping 701 connecting the delivery conduit 32 to a tap 702 for water from the water supply system and piping 703 connecting the return conduit 36 to a sump 704 for discharge into the effluent system. In FIG. 7 the other elements are wholly similar to those of the first embodiment. They have therefore been denoted with the same reference numeral and are not commented on here.

Thus a texturing machine has been provided in which, by appropriately controlling the temperature of the cooling fluid and the speed of circulation of the same inside the cooling system, it is possible to achieve the cooling required for each type of fibre. Setting of these quantities is easily performed directly by the operator of the texturing machine who sets appropriately the control parameters of the refrigerator system, or which can be easily performed by computerized control means. Thus a texturing machine is obtained which is suitable for texturing any type of yarn wherein it is possible to provide for complete automation of the texturing process.

It is naturally understood that what has been written and shown with reference to the preferred embodiments of the present invention has been given purely by way of a non-limiting example of the claimed principle.

What is claimed is:

1. A texturing textile machine comprising: a support framework for at least one yarn heating oven and downstream of the latter a yarn texturing spindle, a surface for contact and cooling a hot yarn running thereon, at least one heat exchanger in contact with the contact and cooling surface for the exchange of heat between a cooling fluid which circulates in the heat exchanger and the contact and cooling surface, means for regulating at least one of the temperature of the cooling fluid and the circulation speed of the cooling fluid, and a refrigerator connected to the heat exchanger for cooling or refrigerating the cooling fluid.

2. A texturing textile machine according to claim 1, wherein the means for regulating regulate the temperature of the cooling fluid.

3. A texturing textile machine according to claim 1, further comprising pump means for circulating the cooling fluid.

4. A texturing textile machine according to claim 1, wherein the means for regulating regulate the circulation speed of the cooling fluid.

5. A texturing textile machine according to claim 1, further comprising means for regulating the flow of the cooling fluid into the heat exchanger.

6. A texturing textile machine according to claim 5, further comprising means for regulating the flow of the cooling fluid out of the heat exchanger.

7. A texturing textile machine according to claim 6, wherein each of the means for regulating the flow of the cooling fluid into, and the flow of the cooling fluid out of the heat exchanger comprise a gate valve for intercepting the cooling fluid, and means for controlling the gate valve in order to regulate or prevent circulation of the cooling fluid inside the heat exchanger.

8. A texturing textile machine according to claim 7, wherein the means for controlling the gate valve comprise manually operable means operatively connected to the gate valve for controlling the opening and closing thereof.

9. A texturing textile machine according to claim 1, wherein the heat exchanger comprises a tubular element for circulation-of the cooling fluid.

10. A texturing textile machine according to claim 9, wherein the tubular element and the surface for contact and cooling of the yarn are made in a single unitary and integrated body.

11. A texturing textile machine according to claim 10, wherein the unitary and integrated body is made of aluminum.

12. A texturing textile machine according to claim 9, wherein the tubular element comprises a feed hole positioned at one end of the tubular element and an exhaust hole positioned at an opposite end of the tubular element, said feed hole being arranged lower than the exhaust hole so as to provide for circulation of the cooling fluid inside the tubular element in an upward direction.

13. A texturing textile machine according to claim 1, wherein the surface for contact and cooling of the hot yarn running thereon is positioned between the yarn heating oven and a related texturing spindle.

14. A texturing textile machine according to claim 1, further comprising means for connecting the heat exchanger to a water supply system, and means for discharging cooling water into a drain system.

15. A texturing textile machine according to claim 1, further comprising means for pressing the yarn against the surface of contact and cooling for the yarn, the means for pressing being positioned upstream of each contact and cooling surface between the latter and the yarn heating oven.

16. A texturing textile machine according to claim 15, wherein the means for pressing the yarn against the surface of contact and cooling are attached directly to the yarn heating oven.

17. A texturing textile machine according to claim 15, wherein the means for pressing the yarn against said surface of contact and cooling comprise a tilting pressing rod having an end for contacting and thrusting the yarn against the surface, and means for locking the rod in a position of contact and pressing of the yarn.

18. A texturing textile machine according to claim 17, wherein the means for locking the rod comprise a peg adapted to be inserted in a cavity of the rod, and elastic thrust means for pushing the peg into the cavity.

19. A texturing textile machine having a plurality of texturing sections according to claim 5, comprising a first delivery conduit and a second return conduit, each of the conduits having a plurality of holes aligned and longitudinally spaced for feeding the cooling fluid to a plurality of heat exchanger elements for respective yarns.

20. A texturing textile machine according to claim 19, wherein the means for regulating the flow of the cooling fluid into the heat exchanger is inserted in a connection between the first delivery conduit and the heat exchanger; and the means for regulating the flow of the cooling fluid out of the heat exchanger is inserted between the heat exchanger and the second return conduit.

21. A texturing textile machine according to claim 20, wherein the heat exchanger comprises a tubular element having a feed hole positioned at one end and an exhaust hole at an opposite end, and respective connection hoses being provided between the delivery conduit and the feed hole, and between the return conduit and the exhaust hole; and parts for intercepting the cooling fluid being respectively positioned upstream of the connection hoses.

* * * * *